US010883357B1

(12) United States Patent
Orbell et al.

(10) Patent No.: US 10,883,357 B1
(45) Date of Patent: Jan. 5, 2021

(54) AUTONOMOUS DRILLING PRESSURE CONTROL SYSTEM

(71) Applicant: ADS Services LLC, Midland, TX (US)

(72) Inventors: Charles Robert Orbell, Satellite Beach, FL (US); Christian Leuchtenberg, Singapore (SG)

(73) Assignee: ADS Services LLC, Midland, TX (US)

( * ) Notice: Subject to any disclaimer, the term of this patent is extended or adjusted under 35 U.S.C. 154(b) by 256 days.

(21) Appl. No.: 15/878,693

(22) Filed: Jan. 24, 2018

(51) Int. Cl.

| | |
|---|---|
| ***E21B 44/06*** | (2006.01) |
| ***E21B 47/06*** | (2012.01) |
| ***E21B 21/08*** | (2006.01) |
| *E21B 47/09* | (2012.01) |

(52) U.S. Cl.
CPC ..... *E21B 44/06* (2013.01); *E21B 21/08* (2013.01); *E21B 47/06* (2013.01); *E21B 47/09* (2013.01)

(58) Field of Classification Search
CPC ..... E21B 34/16; E21B 44/06; E21B 21/08; E21B 47/06
See application file for complete search history.

(56) References Cited

U.S. PATENT DOCUMENTS

| | | | | |
|---|---|---|---|---|
| 5,236,054 | A * | 8/1993 | Jack | E21B 7/028 175/57 |
| 5,615,276 | A * | 3/1997 | Lin | G01N 13/02 382/100 |
| 7,044,237 | B2 | 5/2006 | Leuchtenberg | |
| 7,278,496 | B2 | 10/2007 | Leuchtenberg | |
| 7,367,411 | B2 | 5/2008 | Leuchtenberg | |
| 7,650,950 | B2 | 1/2010 | Leuchtenberg | |
| 8,360,170 | B2 | 1/2013 | Leuchtenberg | |
| 8,657,034 | B2 | 2/2014 | Leuchtenberg | |
| 9,051,803 | B2 | 6/2015 | Leuchtenberg | |
| 9,388,650 | B2 | 7/2016 | Leuchtenberg | |
| 9,605,502 | B2 | 3/2017 | Leuchtenberg et al. | |
| 2007/0065337 | A1* | 3/2007 | Jiang | E21B 47/10 422/53 |
| 2014/0090888 | A1* | 4/2014 | Smith | E21B 21/106 175/38 |
| 2014/0202768 | A1* | 7/2014 | Noske | E21B 21/103 175/57 |
| 2017/0138154 | A1* | 5/2017 | Burdick | G05D 7/0635 |

* cited by examiner

*Primary Examiner* — Kristyn A Hall

(57) ABSTRACT

An autonomous drilling pressure control system for use with a drilling rig includes a pressure control device for controlling pressure within an annulus of an associated well, an electronic pressure sensor for monitoring pressure within the annulus, and an electronic position indicator for indicating a position of the pressure control device. A control subsystem independent of the drilling rig and responsive to the pressure sensor is provided for manipulating the pressure control device to control the pressure within the annulus of the associated well. At least one dedicated power source independent of the drilling rig supplies power to the pressure sensor and position indicator.

18 Claims, 4 Drawing Sheets

AUTONOMOUS DRILLING PRESSURE CONTROL SYSTEM

FIELD OF INVENTION

This invention relates in general to fluid drilling equipment and in particular to a pressure control system for use in fluid drilling equipment.

BACKGROUND OF INVENTION

In drilling a well, a drilling tool or "drill bit" is rotated under an axial load within a bore hole. More specifically, the drill bit is attached to the bottom of a string of threadably connected tubulars or "drill pipe" located in the bore hole. The drill pipe is rotated at the surface of the well by an applied torque, which is transferred by the drill pipe to the drill bit. As the bore hole is drilled, the hole bored by the drill bit is substantially greater than the diameter of the drill pipe. To assist in lubricating the drill bit, drilling fluid or gas is pumped down the drill pipe. The fluid jets out of the drill bit, flowing back up to the surface through the annulus between the wall of the bore hole and the drill pipe.

Conventional oilfield drilling typically uses hydrostatic pressure generated by the density of the drilling fluid or mud in the wellbore, in addition to the pressure developed by pumping of the fluid to the borehole, to move the drilling fluid or mud through the annulus and back to the surface. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with a low change in pressure. Underbalanced drilling is drilling with the hydrostatic head pressure of the drilling fluid intentionally designed to be lower than the pressure of the formations being drilled. The hydrostatic head pressure of the fluid may naturally be less than the formation pressure, or it can be induced.

Rotating diverter heads provide a means of sealing off the annulus around the drill pipe as the drill pipe rotates and translates force axially down the well. A rotating diverter typically includes a side outlet through which the return drilling fluid is diverted. When drilling under pressure, a means of pressure control is attached to the side outlet, which enables the pressure in the annulus to be controlled. Such systems have been used in the industry for some time and are available in varying degrees of complexity. As a minimum, they will have at least one controllable restricting orifice device, such as a drilling choke or pressure control valve. In the simplest form, this restricting device is manually operated or controlled by direct human intervention.

In more complex systems, the side outlet leads to a manifold with multiple control devices, which are controlled by software responsive to the annulus pressure and/or other inputs from the drilling rig, such as flow rate down the drill pipe, return flowrate, and stand pipe pressure to name a few. Typically, such systems are integrated with the drilling rig systems, being dependent on electric power, air supply and resources supplied from the drilling rig. Disadvantageously, such complex choke/pressure control systems have led to substantial increases in footprint size, rig-up time, and the number of required operational personnel, and consequently increases in rigging and operating costs, In addition, the complexity of these choke/pressure control systems has increased their interdependence with the drilling rig.

With the advent of shale exploitation, which has resulted in a very substantial increase number of wells being drilled that must be very cost effective along the whole well construction path, there exists a need for a drilling pressure control system that eliminates direct human interaction, but at the same time does not have the complexity and subsequent cost issues of the current solutions. Such a pressure control system also should be independent of the drilling rig system to eliminate engineering time for integration of the pressure control system with the drilling rig system. In addition, while the direct connection of hardware (e.g., power cables, instrumentation cables, data cables, air supplies, and so on) to the side outlet cannot be avoided, such a pressure control system should also minimize rig-up time, was well as minimize the number of overall failure points across the drilling rig systems and the pressure control system.

In sum, what is required is an independent, autonomous pressure control system that can be easily, and cost effectively, employed with minimal drilling rig interfacing, which still retains the automation capability of the current complex, hardware and connection intensive solutions.

SUMMARY OF INVENTION

An autonomous drilling pressure control system that is independent of the drilling rig systems. This system can be connected in less time than other available system. The system can also be supplied with wireless interfaces to eliminate cabling requirements and to allow remote operation.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1-4 of the drawings, in which like numbers designate like parts.

A new design for a drilling pressure control system is disclosed for connecting to the side outlet of a drilling annulus for drilling under pressure or providing a safety system when not drilling under pressure. This is different from existing designs in that it is autonomous and independent of the drilling rig and the drilling rig systems. Drilling rig systems and data may be added to or used in conjunction with the new design, but they are not required for the operation of the system. The system has the further advantage of being able to be equipped with modern wireless data and control system so as to eliminate data and control cable rig-up. The system design has the further advantage of being packaged in such a way so as to make it the simplest, easiest and fastest system to connect to a well bore for a pressured drilling operation.

Figure 1:
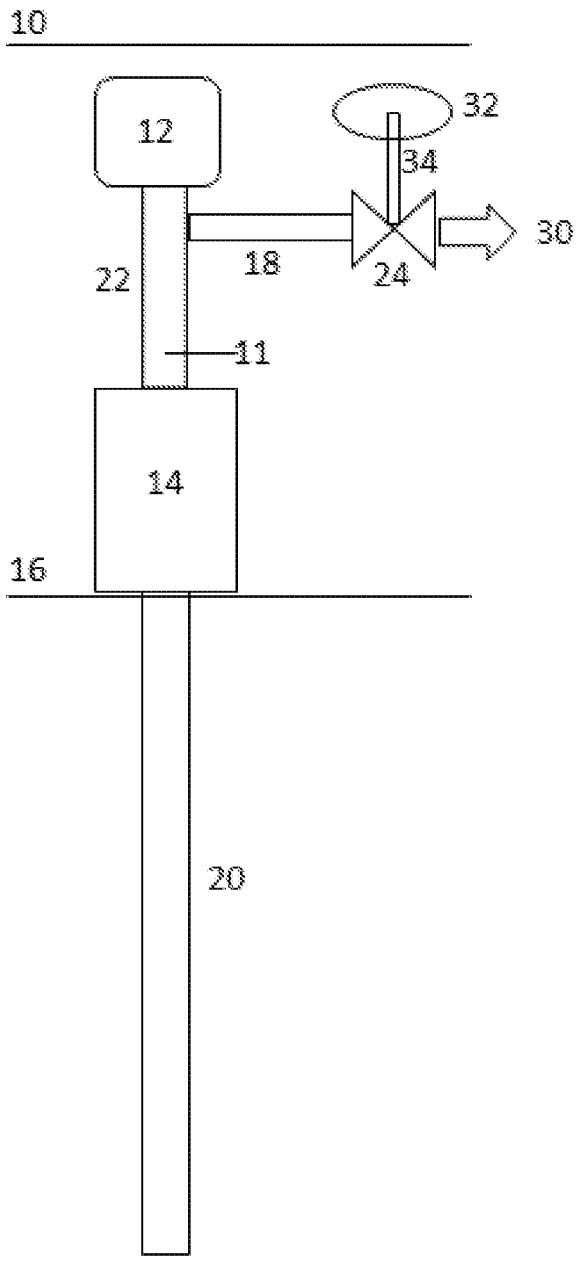
FIG. 1 is a schematic side view drawing showing the location of a representative pressure control system according to the present invention in a typical drilling system.

FIG. 1 is a schematic side view drawing showing the location of the present invention. In particular, in FIG. 1, the ground level is generally shown at 16 and the rig floor level of the drilling rig is generally shown at 10. The system includes a Blow Out Preventer (BOP) 14, a Rotating Control Head (RCH) 12, and the external casing forming the return annulus 20 of the wellbore. (For simplicity, the drill pipe and drill bit are not shown).

Annulus 20, which carries the returning drilling fluid, is connected via BOP 14 to the RCH 12 through a pipe 22. RCH 12 isolates pipe 22 from the atmosphere and causes an internal pressure 11, which is flow diverted through a side outlet 18. Side outlet 18 is associated with a pressure control valve (PCV) 24, which controls the internal pressure resulting in more or less outlet flow 30. PCV 24 is controlled by a stem 34, which is manipulated by an actuator 32 for opening and closing PCV 24 as desired, either manually or to a pre-determined setpoint pressure 11 to be held internal to pipe 22. Stem 34 can have either a rotary or reciprocating movement, depending on the exact valve type of PCV 24, and consequently actuator 32 will also either be a translational or rotary movement device.

Figure 2:
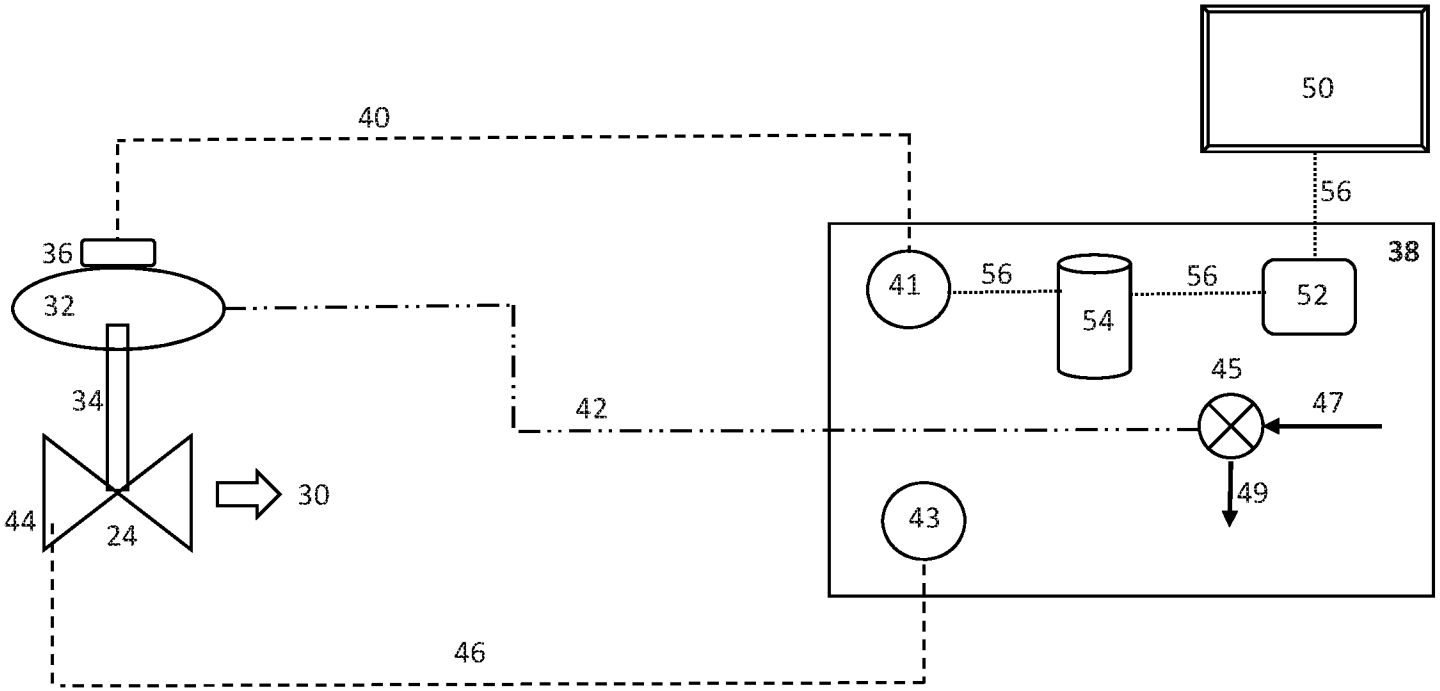
FIG. 2 is a block diagram of a representative pressure control system according to the present invention.

FIG. 2 is a block diagram of a pressure control system according to the present invention. Advantageously, this system is independent and autonomous from the drilling rig system.

As shown in FIG. 2, PCV 24 is controlled from a remote movable control panel 38 that is typically installed at rig floor level 10, which includes a pressure gauge 43 connected by a pressure hose 46 to point 44 upstream of PCV 24 for determining the internal pressure 11 in pipe 22 of FIG. 1. Based on the pressure information from pressure gauge 43, a person can manually operate a manual regulator valve 45 to provide air pressure through line 42 to actuator 32. Actuator 32 can be one of number of known types of actuators. For example, actuator 32 may be an actuator that closes with spring pressure and opens with increasing air pressure. Manual regulator valve 45 is supplied with regulated air pressure through line 47 and can also provide bleed air pressure from line 42 through outlet 49. Thus, by manipulating manual regulator valve 45, the movement of actuator 32 is controlled, which in turn opens or closes the PCV 24 through stem 34.

By opening PCV 24, flow 30 increases, thereby dropping the pressure at point 44, which is equal to the pressure 11 in the annulus 20, upstream of PCV 24, and vice versa. To assist the manual actuation of PCV 24, a position indicator 36 is associated with actuator 32. A typical open/closed visual indicator may not be sufficient for the required fine control of PCV 24; therefore position indicator 36 is preferably an electronic position indicator, which transmits a signal along control and power supply line 40 to a display unit 41 at control panel 38 within the field of view of the operator. Preferably, display unit 41 shows from 0 to 100% opening position of PCV 24. In one embodiment, the indicator system including the position indicator 36 and display unit 41 is based on a 4 to 20 mA loop with 4 mA being equal to zero, i.e. fully closed, 0% open and 20 mA equal to 100% open. Display unit 41 and the associated position indicator 36 can be powered from a small power source, such as a battery 54 supplied by the solar panel 50 through a charge regulator 52 and connecting cables 56. In other words, in the simplest version of this new system the pressure 11 is manually controlled at the remote panel 38 situated on the rig floor 10 by manipulation of valve 45 based on observation of pressure gauge 43 and direct feedback of pressure control valve position from display 41.

Figure 3:
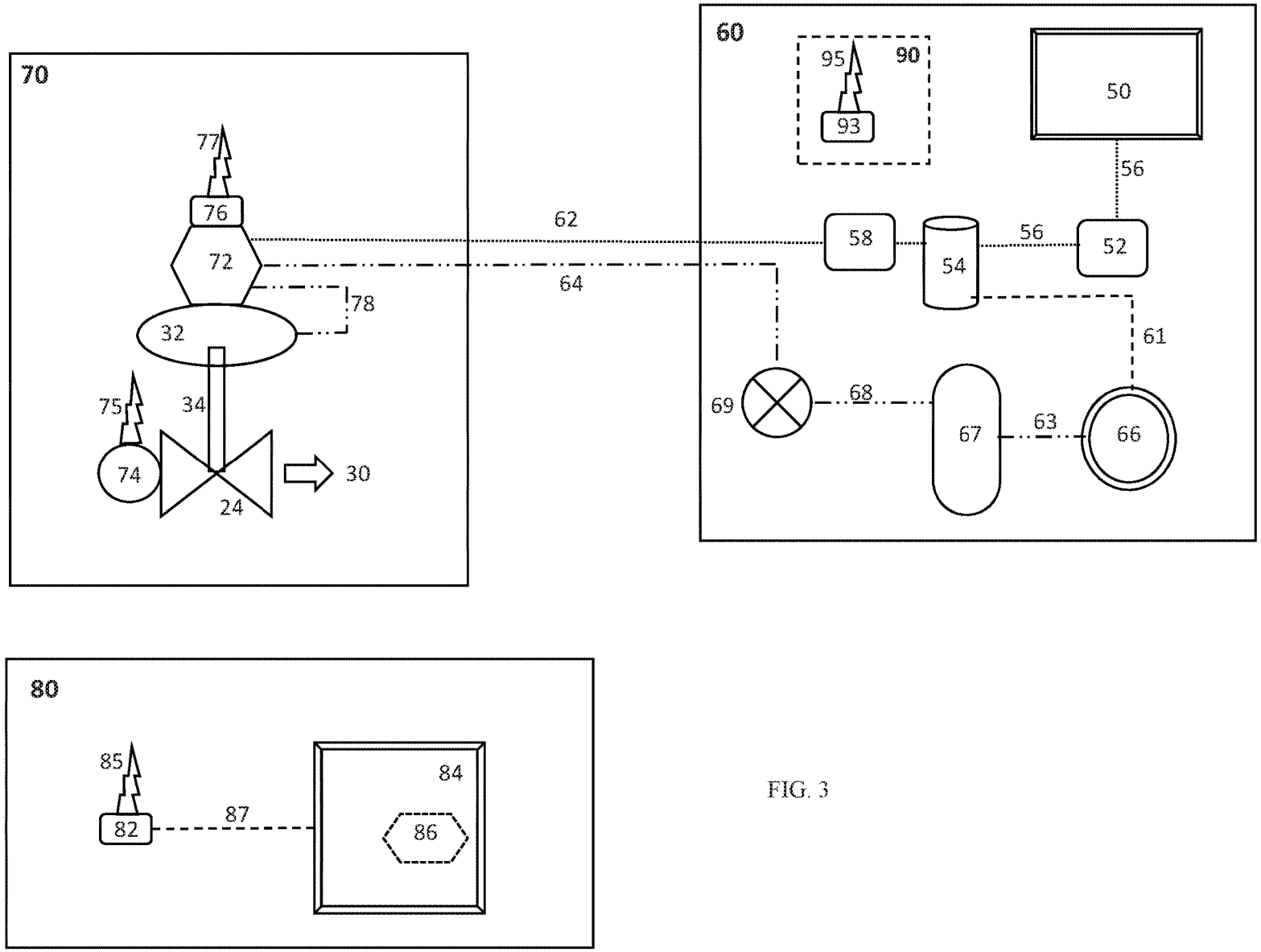
FIG. 3 is a diagram showing one possible practical packaging solution of the pressure control system of FIG. 2 providing minimal rig-up time by introducing automation and wireless technology and FIGS. 4*a* and 4*b* are diagrams showing more advanced control and measurement embodiments of the principles of the present invention.

FIG. 3 shows one possible practical packaging solution of the invention to demonstrate minimal rig-up time by utilizing wireless technology and enabling remote control of the system. The illustrated embodiment of FIG. 3 includes three separate systems: a control module 70, which is situated on or close to the PCV 24; a power module 60; and the remote-control module 80.

Power module 60 is configured to independently provide air and electrical power to control module 70 and preferably does not provide any control function. In the illustrated embodiment, power module 60 provides air flow at a regulated pressure out via air line 64, as well as electrical power in the 4 to 20 mA configuration at the required instrumentation voltage via line 62. Line 62 consists of at least two conductive wires or more cores as required by the 4 to 20 mA current loop. Power module 60 includes solar panel 50, charge regulator 52, power cable 56, and battery 54. Power from battery 54 is passed to an uninterrupted power supply module 58 (optional), which in turn provides power on line 62.

For pneumatic power, an electric air compressor 66 draws power from battery 54 via line 61 and creates compressed air, which is stored in a cylinder, air reservoir 67, supplied by line 63. From air reservoir 67, the compressed air is supplied to a pressure regulator 69 via line 68. Check valves may be present but are not shown.

In the illustrated embodiment, the pressure control valve 24 can be an eccentric rotary plug valve operated with an electro-pneumatic valve positioner 72 and the actuator 32 can be an eccentric rotary plug valve actuator. The electro pneumatic positioner 72 is supplied with electric & control power and pneumatic power by lines 62 and 64, respectively, from power module 60. The electro pneumatic positioner 72 uses electric solenoid valves to manipulate the air supply to the actuator 32 through line(s) 78. Electro pneumatic positioner 72 is controlled by a wireless gateway 76, which receives a remote-control signal via antenna 77. A wireless pressure transducer 74 tied in upstream of PCV 24 transmits pressure data wirelessly via an antenna 75 to the control module 80.

In the illustrated embodiment, the output from transducer 74 and antenna 75 is one-way (i.e., transmit only). Communication from wireless gateway 76 and antenna 77 is twoway (i.e., data on valve position are sent and data for manipulating valve position are received). Other minor data may also be transmitted through wireless gateway 76 and antenna 77 for monitoring the system characteristics for monitoring and troubleshooting purposes. This can be achieved by industry standard HART, Foundation Fieldbus or Modbus data transmission as commonly used in the control system industry. Also even though an electro pneumatic positioner is disclosed in this embodiment, any commonly used other positioners can be applied such as pneumatic or electric positioners.

Remote control module 80 is an independent and autonomous control module including a CPU (Central Processing Unit) 84, which can be a computer of portable type, desktop type or a preprogrammed PLC (Process Logic Controller). CPU 84 includes control software 86 that can accept inputs from control module 70 and/or power module 60, process or monitor these inputs and provide alarms, output control signal or other required data processing functions. Remote control module 80 receives and transmits data via a network cable 87 connected to a wireless gate 82, which transmits and receives via antenna 85. For example, remote control module 80 can receive pressure data from pressure sensor 74 on control module 70, apply a pressure set point algorithm based on the data, and transmit a response signal to wireless gateway 76 on control module 70 to adjust the opening and closing of PCV 24 and set a desired pressure upstream of valve 24 to manipulate the annulus pressure 11. The data from wireless gateway 90 on power module 60 is optional and can be used for monitoring purposes of the power supplies.

In sum, the system as described in FIG. 3 provides a completely independent and autonomous drilling pressure control solution that allows automated control of the annulus pressure 11 without human intervention except for providing the pressure setpoint desired for the annulus 20.

Figure 4A:
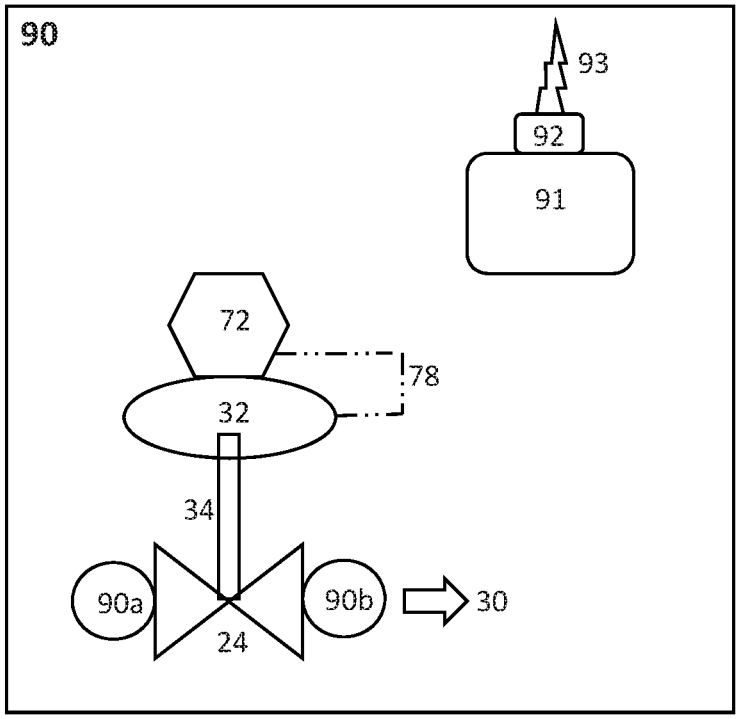
Figure 4B:
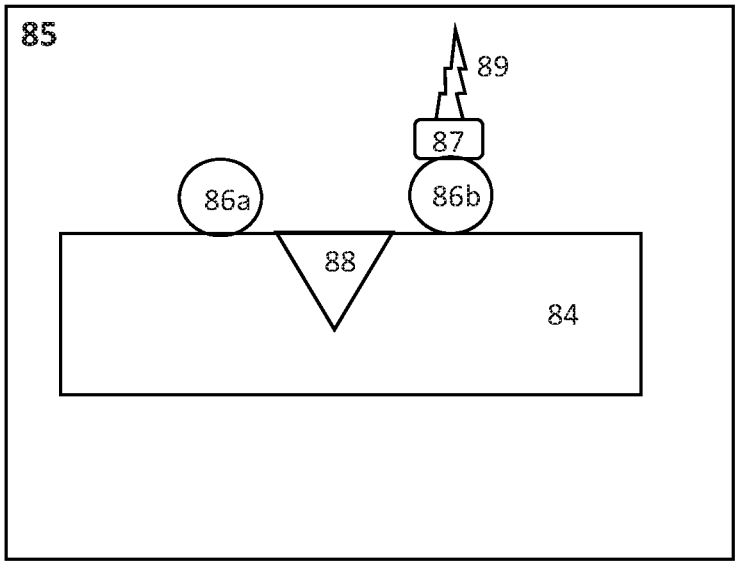

For certain applications, obtaining other or additional data may be advantageous, which is supported by the modules shown in FIGS. 4*a* and 4*b*. In particular, FIG. 4*b* shows a flow measurement module 85, which can be placed upstream or downstream of the control module 70. Flow measurement module 85 can embody any type of mass or rate flowmeter, as appropriate for the conditions. For example, in some embodiments, the flow measurement module comprises a differential pressure type flowmeter utilizing a restriction device. In some embodiments, the flow measurement module comprises a densitometer upstream of the flowmeter. In some embodiments, the flow measurement module comprises a vibrating tube type densitometer. In some embodiments, the flow measurement module comprises a Coriolis-type mass measurement device. In embodiment of 4*b*, a wedge meter 84 is depicted schematically with a wedge 88. Differential pressure transducers 86*a* and 86*b* measure the differential pressure created and the measurement is transmitted as a single differential pressure data value via wireless gateway 87 and antenna 89 to the remote control module 80 (FIG. 3). Typically, a temperature sensor (not shown) is also present for this type of meter and the data transmitted in the same manner as for the differential pressure.

FIG. 4*a* shows a further embodiment of the principles of the present invention, which includes a differential pressure sensor across PCV 24 consisting of two pressure sensors 90*a* and 90*b*. In particular, pressure sensor 90*a* fulfills the same function as pressure sensor 74 in FIG. 3, namely, measuring the annulus pressure 11. Given that positioner 72 provides the precise position of the control valve opening (i.e., provides a reference orifice), the flowrate can be determined by measuring the differential pressure between sensors 90*a*, 90*b*. Preferably, a temperature sensor (not shown) is also used.

In other words, precise flow rate calculations can be made from the coefficient of flow through PCV 24, as measured by positioner 72 and the stem 34 travel at that point in time. However, as PCV 24 moves, the Cv (coefficient of flow) is continuously changing and therefore transmission of data wirelessly to remote control unit 80 and receiving control input for positioner 72 is impractical due to the transmission and processing time lags. Therefore in the embodiment of FIG. 4*a*, all the data from the sensors, including differential pressure sensors 90*a* and 90*b* and the temperature sensor, and positioner data are directly wired into a local PLC (process logic control) module 91. Local PLC 91 preferably performs all the flow measurement calculations, as well as the control calculations to continuously position PCV 24. The calculated flow rate and raw data can be transmitted via the wireless gateway 92 and antenna 93 to remote control unit 80.

Local PLC module 91 is preferably mounted directly beside or on the control valve 24. This configuration supports a very high data sampling rate, which enables flow measurement from a moving control valve, while simultaneously adjusting PCV 24 with positioner 72 through actuator 32 and stem 34 based on the pressure set point required for annulus 11. Local PLC 91 can be programmed with a control loop feedback mechanism like a proportional-integral-derivative (PID) algorithm or similar such control mechanism as commonly used in the process industry. In this case, the remote control unit 80 performs more of a monitoring function and provides a way to change pressure set points when required, with the local PLC doing the full control work. Advantageously this makes the function of PCV 24 fully autonomous and the system will continue to function even if contact with the remote control unit 80 is lost. This is a key advantage that is not disclosed in other such drilling control systems on the market.

In alternate embodiments of the systems set out in FIGS. 3, 4*a* and 4*b*, control module 70 is similarly configured with a local PLC 91 with or without metering.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. An autonomous drilling pressure control system for use with a drilling rig, comprising:

a pressure control device for controlling pressure within an annulus of an associated well;

an electronic pressure sensor for monitoring pressure within the annulus;

an electronic position indicator for indicating a position of the pressure control device;

a control subsystem independent of the drilling rig and responsive to the pressure sensor for manipulating the pressure control device to control the pressure within the annulus of the associated well; and at least one dedicated power source independent of the drilling rig for supplying power to the pressure sensor and position indicator; and a remote control module disposed remotely from the control subsystem and including a processor and first wireless gateway;

wherein the pressure control device comprises a pressure control valve;

wherein the control subsystem comprises:

an actuator for operating the pressure control valve; and an electro-pneumatic positioner for controlling air supplied to the actuator for operation of the pressure control valve; and wherein the dedicated power source comprises:

an electrical power supply that is independent of the drilling rig for supplying electrical power to the electro-pneumatic positioner;

a pneumatic power supply that is independent of the drilling rig for supplying air to the electro-pneumatic positioner; and wherein the electrical power supply and the pneumatic power supply are powered by a common electrical battery that is independent of the drilling rig; and wherein the dedicated power source provides no control signals to the control subsystem for operation of the pressure control valve; and wherein the remote control module is adapted to receive, using the first wireless gateway, pressure data from a second wireless gateway operably connected to the electronic pressure sensor.

2. The autonomous drilling pressure control system of claim 1, wherein the position indicator includes an output to a display unit and a second display unit for displaying data from the electronic pressure sensor and the control subsystem is adapted for manual manipulation of the pressure control device.

3. The autonomous drilling pressure control system of claim 1, wherein the control subsystem is responsive to a set point pressure.

4. The autonomous drilling pressure control system of claim 1, wherein the dedicated power source comprises a dedicated electric power source including at least one of a solar panel, a wind generator, and a battery assembly.

5. The autonomous drilling pressure control system of claim 1, wherein the dedicated power source comprises a dedicated electric power source including an uninterruptible power supply module.

6. The autonomous drilling pressure control system of claim 1, wherein the pressure sensor and the control subsystem communicate via a wireless link.

7. The autonomous drilling pressure control system of claim 1, wherein the control subsystem further comprises at least one of a process logic controller and central processing unit for executing algorithms for controlling an actuator with a positioner.

8. The autonomous drilling pressure control system of claim 7, wherein the pressure sensor, the control subsystem, and the at least one of a process logic controller and central processing unit communicate via wireless links.

9. The autonomous drilling pressure control system of claim 1, further comprising at least one of a flowmeter and a massmeter.

10. The autonomous drilling pressure control system of claim 9, wherein the flowmeter comprises a differential pressure type flowmeter utilizing a restriction device.

11. The autonomous drilling pressure control system of claim 10, further comprising a densitometer upstream of the flowmeter.

12. The autonomous drilling pressure control system of claim 11, wherein the densitometer comprises a vibrating tube type densitometer.

13. The autonomous drilling pressure control system of claim 9, wherein the massmeter comprises a Coriolis-type mass measurement device.

14. The autonomous drilling pressure control system of claim 1, wherein the pressure control device comprises a pressure control valve and a differential pressure flow measurement device in one unit.

15. The autonomous drilling pressure control system of claim 14, wherein the control subsystem further comprises a local process logic controller for calculating a flowrate continuously.

16. The autonomous drilling pressure control system of claim 1, wherein the control subsystem further comprises a local process logic controller that incorporates a control loop feedback mechanism.

17. The autonomous drilling pressure control system of claim 16, wherein the control subsystem can continue to function independently of external control commands or signals.

18. An autonomous drilling pressure control system for use with a drilling rig, comprising:

a pressure control device for controlling pressure within an annulus of an associated well;

an electronic pressure sensor for monitoring pressure within the annulus;

an electronic position indicator for indicating a position of the pressure control device;

a control subsystem independent of the drilling rig and responsive to the pressure sensor for manipulating the pressure control device to control the pressure within the annulus of the associated well; and at least one dedicated power source independent of the drilling rig for supplying power to the pressure sensor and position indicator; and wherein the pressure control device is an eccentric rotary plug valve operated with an electro-pneumatic valve positioner and the control subsystem provides power generated by the dedicated power source to an eccentric rotary plug valve actuator.

* * * * *